US005301492A

United States Patent [19]

Kader

[11] Patent Number: 5,301,492

[45] Date of Patent: Apr. 12, 1994

[54] BAG CLAMPING DEVICE

[75] Inventor: Karl-Wilhelm Kader, Hennef, Fed. Rep. of Germany

[73] Assignee: Chronos Richardson GmbH, Hennef, Fed. Rep. of Germany

[21] Appl. No.: 990,643

[22] Filed: Dec. 14, 1992

[30] Foreign Application Priority Data

Dec. 14, 1991 [DE] Fed. Rep. of Germany ..... 4141254

[51] Int. Cl.[5] ..... B65B 39/10; B65B 43/34; B65B 43/16

[52] U.S. Cl. ..... 53/459; 53/473; 53/570; 53/384.1

[58] Field of Search ..... 53/571, 572, 573, 260, 53/384.1, 386.1, 459, 570, 473

[56] References Cited

U.S. PATENT DOCUMENTS

| | | | |
|---|---|---|---|
| 3,225,514 | 12/1965 | Inglett | 53/573 |
| 3,750,721 | 8/1973 | Hudson | 53/570 X |
| 4,177,621 | 12/1979 | Powell, Jr. | 53/572 X |
| 4,305,241 | 12/1981 | Tetenborg et al. | 53/573 X |
| 4,432,186 | 2/1984 | McGregor | 53/573 X |
| 4,573,864 | 1/1986 | Eschmann | 53/384.1 X |
| 4,579,154 | 4/1986 | Müller | 53/570 X |

*Primary Examiner*—Horace M. Culver
*Attorney, Agent, or Firm*—Francis N. Carten

[57] ABSTRACT

A bag clamping device for holding a bag to be filled, especially a bag with side folds, on a filling neck, the bag clamping device being formed by: a first pair of clamps, each comprising clamping members for holding opposed first bag wall segments on the filling neck, and a second pair of clamps each comprising pairs of clamping members, the pair of second clamping members comprising first surface parts which, in pairs, rest against one another in such a way that any bag wall parts positioned in front of the end faces are gripped and held in the bag edge region, as well as second surface parts which are arranged at an angle relative to the first surface parts which are adapted to the end faces and guiding plates of the swung-out expanding flaps for the purpose of holding the remaining free bag wall parts tightly around the filling neck.

19 Claims, 2 Drawing Sheets

BAG CLAMPING DEVICE

BACKGROUND OF THE INVENTION

The invention relates to a device for clamping bags around the exit end of the filling neck of a system for filling bags. A known system of this type is the 3200 Series Slidell-Matic System manufactured by Slidell (USA), which includes a bag clamping device. A system of this type is particularly suitable for handling bags with side folds, in which case the bags are pulled over the filling neck with the side folds already folded and are then taken over by a second pair of clamps so that during the subsequent filling operation, the side folds in the region of the bag opening do not open up. Consequently, there is no need for the side folds to be refolded and realigned after the filling operation to permit subsequent closing of the bag; in particular, there is no need for folding over the bag edge prior to the final sewing or gluing operation.

Such bag clamping devices are also advantageous for simple flat bags, especially bags with so-called "pinch-tops", in which the upper bag edge is also folded over for closing purposes. In this case, too, it is essential for the side fold of the bag to remain in its accurate position, i.e., the two bag walls have to be held one against the other in the region of the side edges.

With the above-mentioned device, the bags, after having been slipped on to the filling neck, are held by the first pairs of clamps on the surfaces of the expanding flaps and are fixed by the second pairs of clamps in the region of their side edges at some distance in front of the end faces. Subsequently, suction ports are introduced into the open bag opening in front of the end faces of the filling neck the purpose of such ports being to suck out any air and, in consequence, dust displaced during the filling process. For this purpose, the second pairs of clamps are moved close to the suction ports. Close contact with the planar surfaces of the suction ports and of the expanding flaps is ensured by the resulting vacuum. However, the said devices are also advantageous for simple flat bags, especially bags with so-called "pinch-tops", in the case of which the upper bag edge is also folded over for closing purposes. In this case, too, it is essential for the side fold of the bag to remain in its accurate position, i.e., the two bag walls have to be held one against the other in the region of the side edges.

With the above-mentioned device, the bags, after having been slipped on to the filling neck, are held by the first pairs of clamps on the surfaces of the expanding flaps and are fixed by the second pairs of clamps in the region of their side edges at some distance away from the end faces. Subsequently, suction ports are introduced into the bag opening in front of the end faces of the filling neck, the purpose of such ports being to suck out any air and, in consequence, dust displaced during the filling process. For this purpose, the second pairs of clamps are moved close to the suction ports. Close contact with the planar surfaces of the suction ports and of the expanding flaps is ensured by the vacuum created by the suction ports.

SUMMARY OF THE INVENTION

The present invention is embodied in and carried out by a bag clamping device for holding a bag to be filled, especially a bag with side folds, on a filling neck comprising a housing part which has a substantially rectangular cross-section, which, with two end faces, converges downwardly so as to be wedge-shaped and which comprises two expanding flaps which are held at the housing part so as to be pivotable around the axes positioned perpendicularly relative to the end faces and which comprise rectangularly attached guiding plates positioned inside the end faces. This novel bag clamping device includes:

- a first pair of clamps each comprising clamping members which, at pivot levers, are pivotable in opposite directions around first horizontal axes and which rest against the outer faces of the opened expanding flaps for the purpose of holding opposed first bag wall parts at the filling neck; and
- a second pair of clamps each comprising pairs of clamping members having opposed gripping surfaces and coplanar clamping surfaces, which, at individual short pivot levers, are individually pivotable in opposite directions around second axes positioned approximately parallel to the first axes and which, in pairs, rest against one another in such a way that second bag wall parts positioned in front of the end faces are gripped and held in the edge region, and which are movable in pairs and jointly in opposite directions toward the end faces for the purpose of holding bag wall parts between said first and second wall parts against said end faces and guiding plates.

It is the object of the present invention to provide a clamping device that, even without using suction means introduced into the bag opening outside the cross-section of the filling neck, ensures tight contact between the bag and the filling neck. In accordance with the invention, it is thus possible to achieve almost complete sealing and thereby prevent the escape of dust from the bag during filling. If necessary, air could be extracted from the bag through the interior of the filling neck.

The length of the second additional pivot movement of the second clamping members should preferably be adjusted to be such that the bag walls follow an almost fold-free course along the end surfaces of the filling neck and the guiding plates of the expanding flaps when the clamping members are pivoted against the end faces of the filling neck. However, no damage is caused if, along the edge of the bag opening, there exists a certain free length; slight folds at the edge of the bag opening are harmless, because the clamping members firmly press the bag around the entire periphery of the filling neck. Unfolding of the bag side folds is prevented by the fact that the bag is previously gripped in the region of the side edges. The second surfaces of the second clamping members are preferably provided with setoff portions extending along the inclined delineating edges of the wedge-shaped end faces in order to ensure a uniform pressure against the end faces and guiding plates of the swung-out expanding flaps. The lever arms of the pairs of second clamping members are preferably held on pins mounted on the two longer lever arms so as to be simultaneously rotated toward the filling neck, thereby ensuring uniform contact when pressure is applied to the faces of the filling neck. To avoid the bag material from being damaged, the clamping members, in the region of the contacting faces, are usually made of rubber or coated with rubber or a similar pliable material. The first pair of clamps are preferably designed to be independent of one another, but each pair of the second pairs of clamps are designed so that one joint actuating element generates the first movement of the shorter pivot levers, with their movements being synchronized by a coupling member, and the second movement of the longer pivot levers is also generated by a joint actuating element, with these longer pivot arms also being pivotable in synchronization with each other.

The present invention is advantageously employed in combination with the device for expanding and slipping on bags disclosed and claimed in the co-pending U. S. patent application entitled DEVICE FOR EXPANDING AND SLIPPING ON BAGS filed on even date herewith by the present inventor and assigned to Chronos Richardson GmbH, and the disclosure of said application is incorporated herein by reference.

DESCRIPTION OF THE DRAWINGS

The written description of the present invention will be more fully understood when read with reference to the accompanying drawings, of which.

DETAILED DESCRIPTION OF THE PREFERRED EMBODIMENT

Figure 1:
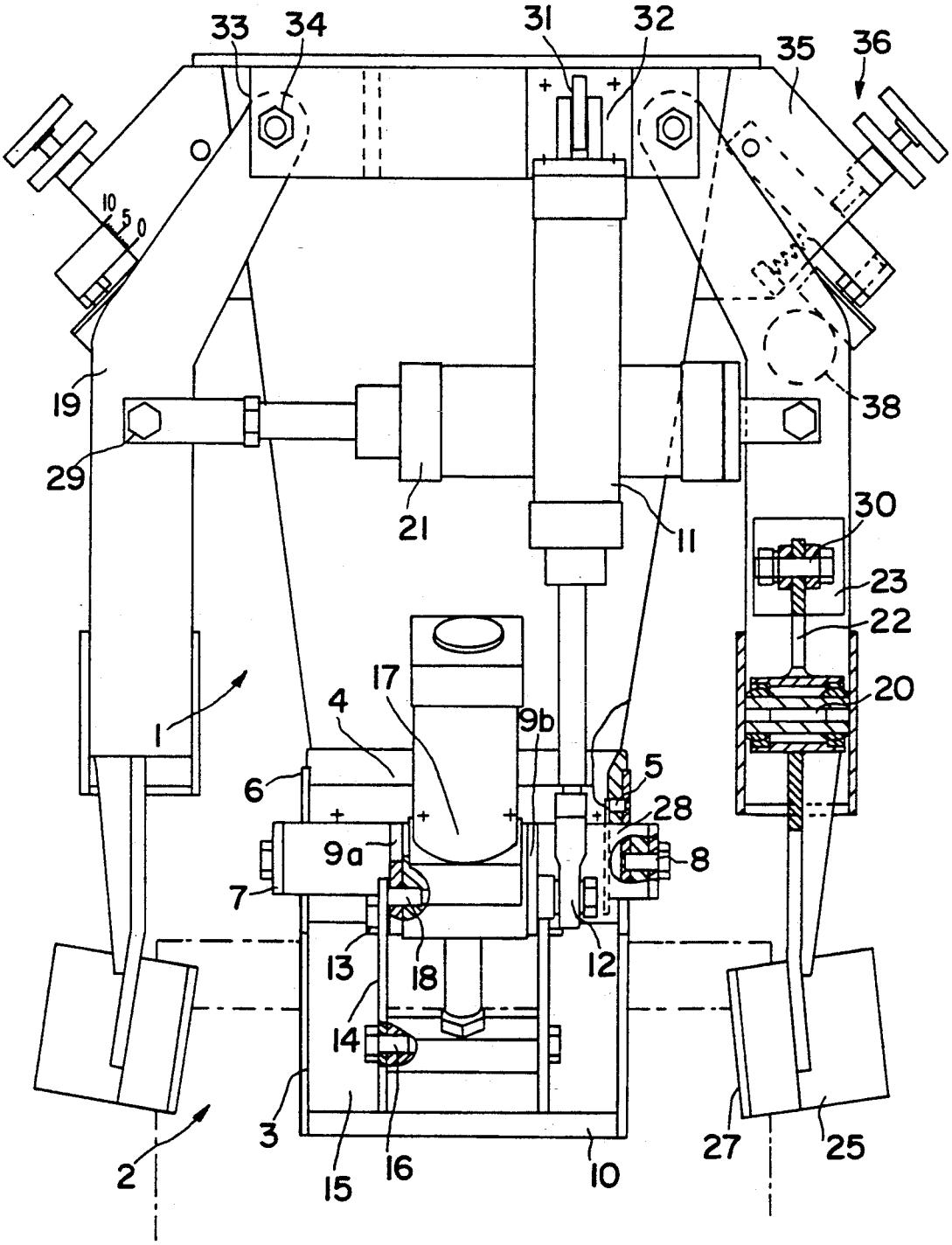
FIG. 1 shows a side elevation of a bag clamping device in accordance with the invention, arranged at a filling neck.
Figure 2:
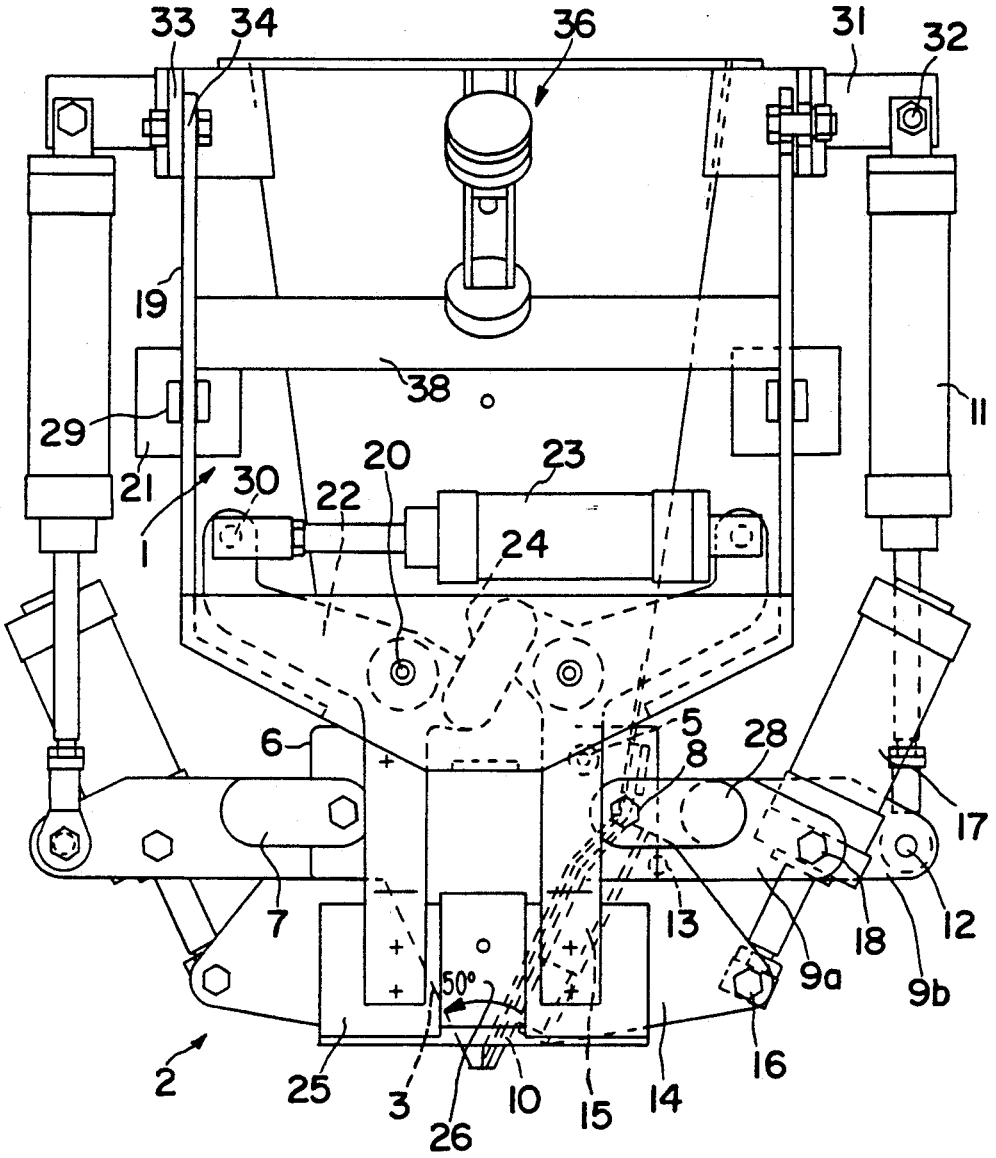
FIG. 2 shows a bag clamping device according to FIG. 1, with a view of the end faces of the filling neck.

The best mode of carrying out the invention is shown in the aforementioned drawing figures and is described in detail hereunder. Corresponding parts have been given identical reference numbers. The description below refers to both drawing figures. The filling neck 1 may be part of a variety of filling machines including, but not limited to, a machine with a fixed single spout; a machine with a swivelled single spout; a six-spout carousel machine; a GE55 gross weigher; and a three-spout carousel machine with de-aeration capability. The filling neck 1 has a substantially rectangular cross-section and comprises a lower housing part 2 whose end faces 3 extend downwardly in a V-shaped configuration, and whose side faces 4 are only partially visible. The lower housing part 2 is welded to the filling neck 1. The end faces 3 are bolted thereto by bolts 5 and comprise upper attachment faces 6 which are laterally embraced by connecting members 7. The inner ends of the connecting members 7 are attached to pivot pins 8 for the expanding flaps 10 and their outer ends are connected to a carrier tube 28. Two arm levers **9*a* and 9*b* are of unequal length, and one end is welded to expanding flaps 10 which are attached to the carrier tube 28. The longer lever 9*b* is acted upon by an actuating cylinder 11 by a rotational axis through pin 12. The upper end of the actuating cylinder 21 is suspended on a connecting piece 31 which is firmly connected to the filling neck 1. The actuating cylinder 11 is supported by a rotational axis through pin 32 which is supported in a connecting piece 31 at the filling neck. When the actuating cylinder 11 is actuated, the expanding flaps pivot laterally outwardly around the rotational axis through pin 8. Between the levers 9*a*, 9*b* there is provided a further rotational axis through pin 13 on which there are supported pairs of triangular plates 14 so as to be jointly rotatable, with clamping members 15 being attached to said plates 14. By a connecting axis through pin 16, the plates 14 are actuated by a further actuating cylinder 17 which is pivotably held between the levers 9*a*, 9*b* in an axis through pin 18**.

The above-mentioned parts function as follows: the expanding flaps 10 may be opened or closed by the actuating elements 11; in particular, they are opened after a bag has been slipped on. During the opening and closing operation, the actuating means of the clamping members 15 attached to the expanding flaps are each carried along. By energizing the actuating elements 17, these clamping members 15 may be pivoted away from the expanding flaps 10 independently of the position of the expanding flaps 10, thereby permitting the bag to be slipped on, and pressed thereagainst so that the bag edge is pressed against the expanding flaps 10, especially when these are in the open position.

In front of each plane of the end faces 3 there are arranged fork-like, double lever arms 19 which, around axes through pins 34, are rotatably attached to connecting members 33 which are also firmly connected to the filling neck 1. The lever arms 19 are actuated by a joint actuating element 21 which is supported in rotational axes through pins 29 and connects the opposed pivot arms 19 to one another and enables them to be moved both toward and away from the end faces 3 of the lower housing part 2 of the filling neck. Thus, the pivot arms 19 may be moved in and out in synchronization with each other around rotational axes through pins 34.

In each of the bridge-like pivot arms 19 there is supported a pair of pivot arms 22 which are pivotable around rotational axes through pins 20. The pivot arms 22 are designed as two-arm levers and are actuated in opposite directions by a joint actuating element 23, with a coupling member 24 connected to both so as to ensure synchronized rotational movements. The actuating element 23 is supported in rotational axes through pins 30 on the pivot arms 22. At the lower ends of the pivot arms 22 there are arranged multi-faced clamping members 25. When the actuating element 23 is actuated, the actuating elements 25 positioned in front of an end face 3 are guided together in such a way that, by opposed faces 26, they are able to grip and hold together a slipped-on bag in the region of the bag's side folds. When subsequently energizing the actuating element 21, the coplanar pressure faces 27 of the two pairs of clamping members 25 are pressed against the end faces 3 of the lower housing part 2, so that, by the coplanar pressure faces 27, they fully press the previously loosely open bag against the end faces 3. The support of the levers 22 around their rotational axes through pins 20 mounted in lever arms 19 is shown partially in section in FIG. 1. Thus, when the clamping members 25 are swung toward the end faces 3, the coplanar pressure faces 27 are moved simultaneously.

The fork-like pivot arms 19 are connected to one another by a transverse member 38. An adjusting device 36 attached to connecting members 35 limits the range of pivot of the lever arms 19. The members 35, in turn, are firmly attached to the filling neck 1.

In the embodiment described above, the novel sequencing of events in the operation of the device for clamping a bag onto a filling neck is effected by known technology, preferably proximity switches on the various air cylinders to detect the position of the air-driven piston therein and, from the indication of the position of that piston, determining whether a particular step in the novel sequence of steps carried out by the device has been completed. In order not to unduly complicate the drawings and thereby obscure the invention, such conventional elements as vacuum hoses, vacuum source, sensors and their connections and related circuitry have not been shown.

Certain modifications and variations of the disclosed embodiment of the present invention will be apparent to those skilled in the art. It should be understood that the disclosed embodiment is intended to be illustrative only, and not in any way restrictive of the scope of the invention as defined by the claims set forth hereunder.

I claim:

1. In a system for filling bags, each having an open end, a closed end, opposed sides, and opposed walls, in which the bags are expanded at their open ends and slipped onto a filling neck having, at its exit end, a pair of opposed expanding flaps each having a side and opposed ends and movable relative to one another to open or close an opening through which a bag can be filled, the improvement comprising: bag clamping means operative to clamp opposed portions of the walls of a bag that has been slipped around the pair of opposed expanding flaps between a pair of opposed end clamps and the sides of the pair of opposed expanding flaps; to clamp portions of the opposing sides of the bag from the outside of the bag in proximity to the open end of the bag; to laterally clamp portions of the walls of the bag against the opposed ends of the pair of the opposed expanding flaps after opening the pair of opposed expanding flaps; after the bag if filled, to laterally unclamp portions of the walls of the bag against the opposed ends of the pair of opposed expanding flaps and close the pair of opposed expanding flaps; to unclamp portions of the opposing sides of the bag in proximity to the open end of the bag; and to unclamp the opposed portions of the walls of the bag.

2. The improvement according to claim 1, wherein the filling neck comprises a housing part which has a substantially rectangular cross-section, which, with two end faces, converges downwardly so as to be wedge-shaped and which comprises two expanding flaps which are held at the housing part so as to be pivotable around axes positioned perpendicularly relative to said end faces, and which comprise rectangularly attached guiding plates positioned inside the end faces, and said bag clamping means comprises:

(a) a first pair of clamping means comprising a first pair of clamping members which are pivotable in opposite directions around first horizontal axes and which rest against the outer faces of the expanding flaps for the purpose of holding opposed first bag wall portions at the filling neck; and (b) a second pair of clamping means, each comprising a pair of clamping members which are individually pivotable in opposite directions around second axes positioned approximately parallel to the first axes and which are movable in pairs and jointly in opposite directions in the direction of the end faces around axes perpendicular to the first and second axes, the pairs of second clamping members comprising opposed surface parts which grip the portions of the opposing walls of the bag positioned in front of the end faces form the outside of the bag, and coplanar surface parts which are adapted to the contours of the end faces and the guiding plates of the opened expanding flaps for the purpose of holding the remaining free bag wall portions at the filling neck.

3. The improvement according to claim 2, wherein each of said first pair of clamping means comprises actuating means which are independent of one another.

4. The improvement according to claim 3, wherein each of said second pairs of clamping means comprises joint actuating means and a synchronizing coupling device, both connected to opposed lever arms for moving said opposed surface parts to and from one another.

5. The improvement according to any one of claims 3 or 4, wherein said second pair of clamping means comprises joint actuating means for moving said pairs of coplanar surface parts to and from the end faces.

6. The improvement according to any one of claims 3 or 4, wherein said second pair of clamping means comprises a pair of longer lever arms rotatable around parallel, spaced axes, and two pairs of shorter lever arms, each pair being mounted in one of said longer lever arms and rotatable around parallel, spaced axes perpendicular to said parallel, spaced axes of said longer lever arms.

7. Bag clamping apparatus for holding a bag to be filled on the filling neck of a system for filling bags, each having an open end, a closed end, opposed sides, and opposed walls, said bag clamping apparatus comprising:

(a) a pair of opposed expanding flaps rotatably mounted at the exit opening of the filling neck, and first and second actuating means for moving said pair of opposed expanding flaps between open and closed positions;

(b) a pair of clamps rotatably mounted with respect to said pair of opposed expanding flaps, and third and fourth actuating means for moving said pair of clamps to clamp opposed portions of the walls of a bag between said pair of clamps and said pair of opposed expanding flaps; and (c) first and second pairs of lateral clamps, each pair rotatably mounted with respect to said pair of opposed expanding flaps, and fifth and sixth actuating means for moving each of said first and second pairs of lateral clamps, respectively, toward one another to grip opposing sides of the bag from the outside of the bag in proximity to the open end of the bag, and seventh actuating means for moving said first and second pairs of lateral clamps toward and against opposed ends of said pair of opposed expanding flaps.

8. Bag clamping apparatus according to claim 7, wherein said first and second actuating means operate independently of one another.

9. Bag clamping apparatus according to claim 7 or 8, wherein said pair of opposed expanding flaps and said pair of clamps rotatably mounted with respect to said pair of opposed expanding flaps are each rotatably mounted by separate, parallel pins.

10. Bag clamping apparatus according to claim 7 or 8, wherein said first and second actuating means comprise first and second actuating cylinders mounted between first and second support means, respectively, said first and second support means being fixed with respect to the filling neck, and the free ends of first and second lever arms, respectively, each of said pair of clamps being rotatably connected to one of said first and second lever arms.

11. Bag clamping apparatus according to claim 7 or 8, wherein said third and fourth actuating means comprise third and fourth actuating cylinders rotatably mounted on said first and second lever arms, respectively.

12. Bag clamping apparatus according to claim 7, wherein said fifth and sixth actuating means comprise first and second pairs of synchronized levers, respectively, said first and second pairs of lateral clamps being mounted at the free ends of said first and second pairs of synchronized levers, respectively, and fifth and sixth actuating cylinders connected between said first and second pairs of synchronized levers, respectively.

13. Bag clamping apparatus according to claim 12, wherein each of said first and second pairs of synchronized levers is interconnected by a synchronizing member.

14. Bag clamping apparatus according to claim 12 or 13, wherein said seventh actuating means comprises first and second longer lever arms rotatably mounted with respect to the filling neck, and a seventh actuating cylinder connected between said longer lever arms for moving said first and second pairs of lateral clamps toward the sides of said pair of opposed expanding flaps, with said first and second pairs of synchronized levers being rotatably mounted on said first and second longer lever arms, respectively.

15. Bag clamping apparatus according to claim 14, wherein said seventh actuating means comprises first and second adjusting means for setting the range of movement of said first and second longer lever arms.

16. Bag clamping apparatus according to claim 7, wherein each of said first and second pairs of lateral clamps comprises opposed surface parts which grip the bag wall parts in the edge region of the bag, and coplanar surface parts for holding the remaining free bag wall parts at the filling neck.

17. Bag clamping apparatus according to claim 16, wherein, in each clamp of said first and second pairs of lateral clamps, said opposed surface part is substantially perpendicular to said coplanar surface part.

18. Bag clamping apparatus according to claim 16 or 17, wherein said opposed surface part and said coplanar surface parts are formed of a pliable material at least in the areas of contact with the bag.

19. A method of clamping the open ends of bags, each having an open end, a closed end, opposed sides, and opposed walls, onto a filling neck having an exit end, a pair of opposed expanding flaps at said exit end, each flap having a side and opposed ends and movable relative to one another to open or close an opening through which a bag can be filled, comprising essentially the steps of:

(a) clamping opposed portions of the walls of a bag that has been slipped around the pair of opposed expanding flaps between a pair of opposed end clamps and the sides of the pair of opposed expanding flaps;

(b) clamping portions of the opposing sides of the bag from the outside of the bag in proximity to the open end of the bag;

(c) laterally clamping portions of the walls of the bag against a part of the filling neck and the opposed ends of the pair of the opposed expanding flaps after opening the pair of opposed expanding flaps;

(d) after filling the bag, laterally unclamping portions of the walls of the bag against the opposed ends of the pair of opposed expanding flaps and closing the pair of opposed expanding flaps;

(e) unclamping portions of the opposing sides of the bag in proximity to the open end of the bag; and (f) unclamping the opposed portions of the walls of the bag.

* * * * *